US009726194B2

(12) United States Patent
Freeman et al.

(10) Patent No.: US 9,726,194 B2
(45) Date of Patent: Aug. 8, 2017

(54) UNIVERSAL HOUSING FOR A CENTRIFUGAL GAS COMPRESSOR

(71) Applicant: SOLAR TURBINES INCORPORATED, San Diego, CA (US)

(72) Inventors: Jess Lee Freeman, Poway, CA (US); Gordon E. Brailean, San Diego, CA (US); Benjamin Dee Freeman, San Marcos, CA (US)

(73) Assignee: Solar Turbines Incorporated, San Diego, CA (US)

( * ) Notice: Subject to any disclaimer, the term of this patent is extended or adjusted under 35 U.S.C. 154(b) by 621 days.

(21) Appl. No.: 14/257,595

(22) Filed: Apr. 21, 2014

(65) Prior Publication Data

US 2015/0300366 A1 Oct. 22, 2015

(51) Int. Cl.

| | |
|---|---|
| ***F04D 29/42*** | (2006.01) |
| ***F04D 17/12*** | (2006.01) |
| ***F04D 29/62*** | (2006.01) |

(52) U.S. Cl.

CPC ..... *F04D 29/4206* (2013.01); *F04D 17/125* (2013.01); *F04D 29/624* (2013.01)

(58) Field of Classification Search

CPC ..... F04D 29/4206; F04D 29/624; F04D 29/2222; F04D 17/125; F04D 29/30; F04D 29/286

See application file for complete search history.

(56) References Cited

U.S. PATENT DOCUMENTS

| | | | | |
|---|---|---|---|---|
| 3,927,763 | A | 12/1975 | Strub et al. | |
| 4,493,611 | A | 1/1985 | Funakoshi et al. | |
| 6,568,904 | B1 * | 5/2003 | Ueyama | F04D 29/668 415/199.2 |
| 7,396,203 | B2 | 7/2008 | Martindale | |
| 8,558,422 | B2 | 10/2013 | Baumann et al. | |
| 2008/0031732 | A1 | 2/2008 | Peer et al. | |
| 2012/0099961 | A1 | 4/2012 | Delvaux et al. | |
| 2012/0099995 | A1 | 4/2012 | Delvaux et al. | |
| 2012/0099996 | A1 | 4/2012 | Delvaux | |
| 2013/0259644 | A1 | 10/2013 | Kobayashi et al. | |

FOREIGN PATENT DOCUMENTS

| | | |
|---|---|---|
| KR | 101023783 B1 | 3/2011 |
| WO | 2013047507 | 4/2013 |

* cited by examiner

*Primary Examiner* — Mark Laurenzi
*Assistant Examiner* — Shafiq Mian
(74) *Attorney, Agent, or Firm* — Procopio, Cory, Hargreaves & Savitch LLP

(57) ABSTRACT

A universal housing for a centrifugal gas compressor is disclosed. The universal housing includes a body, a suction port extending from the body, a discharge port extending from the body, and a first compartment within the body. The first compartment includes a suction inlet in flow communication with the suction port and a discharge outlet in flow communication with the discharge port. The first compartment is configured to receive more than one staging length for the staging. The staging inlet is in flow communication with the suction inlet and the staging outlet is in flow communication with the discharge outlet.

4 Claims, 4 Drawing Sheets

UNIVERSAL HOUSING FOR A CENTRIFUGAL GAS COMPRESSOR

TECHNICAL FIELD

The present disclosure generally pertains to centrifugal gas compressors, and toward a universal housing for a centrifugal gas compressor with a spacerless rotor.

BACKGROUND

Centrifugal gas compressors often include multiple stages for compression. The length of each stage of a centrifugal gas compressor may depend on the compression needs of the operator. The length of the housing for the centrifugal gas compressor may depend on the overall length of the staging. The length of the housing may be designed around that length. In other configurations, the length of the rotor may be expanded to fit within a housing using rotor spacers.

The present disclosure is directed toward overcoming one or more problems discovered by the inventors or that is known in the art.

SUMMARY OF THE DISCLOSURE

A centrifugal gas compressor is disclosed. In embodiments, the centrifugal gas compressor includes a universal housing, a first compartment, first compartment staging, an endcap and a stator spacer. The universal housing includes a body with a center axis. The first compartment includes a suction inlet, a discharge outlet, and a first compartment length including the suction inlet, the discharge outlet, and an axial space there between. The suction inlet is formed in the body and is a circumferential slot. The discharge outlet is formed in the body axially spaced apart from the suction inlet. The discharge outlet is a second circumferential slot.

The first compartment staging is located within the first compartment and includes a staging inlet, a staging outlet, and a staging length. The staging inlet is located within an axial envelope of the suction inlet. The staging outlet is in flow communication with the discharge outlet. The staging length is an axial length from the staging inlet to the staging outlet. The staging length is from a first length to a second length, the second length being fifteen percent or more of the first length. The endcap is located adjacent the first compartment staging and at least partially within the universal housing. The stator spacer is located adjacent the endcap and is configured to locate the endcap within the universal housing.

DETAILED DESCRIPTION

The system disclosed herein includes a centrifugal gas compressor with a universal housing. In embodiments, the universal housing includes one or more compartments, each including a suction inlet and a discharge outlet. The universal housing and the compartments are configured to allow for a number of different length rotors/rotor assemblies, and the associated staging within the universal housing, such as by including either a suction inlet or a discharge outlet with an extended axial length in one or more of the compartments. A universal housing may allow for the use of low cost castings during the manufacturing process and may allow the housing to be designed prior to staging selection, which may reduce both the cost and delivery time of the centrifugal gas compressor.

Figure 1:
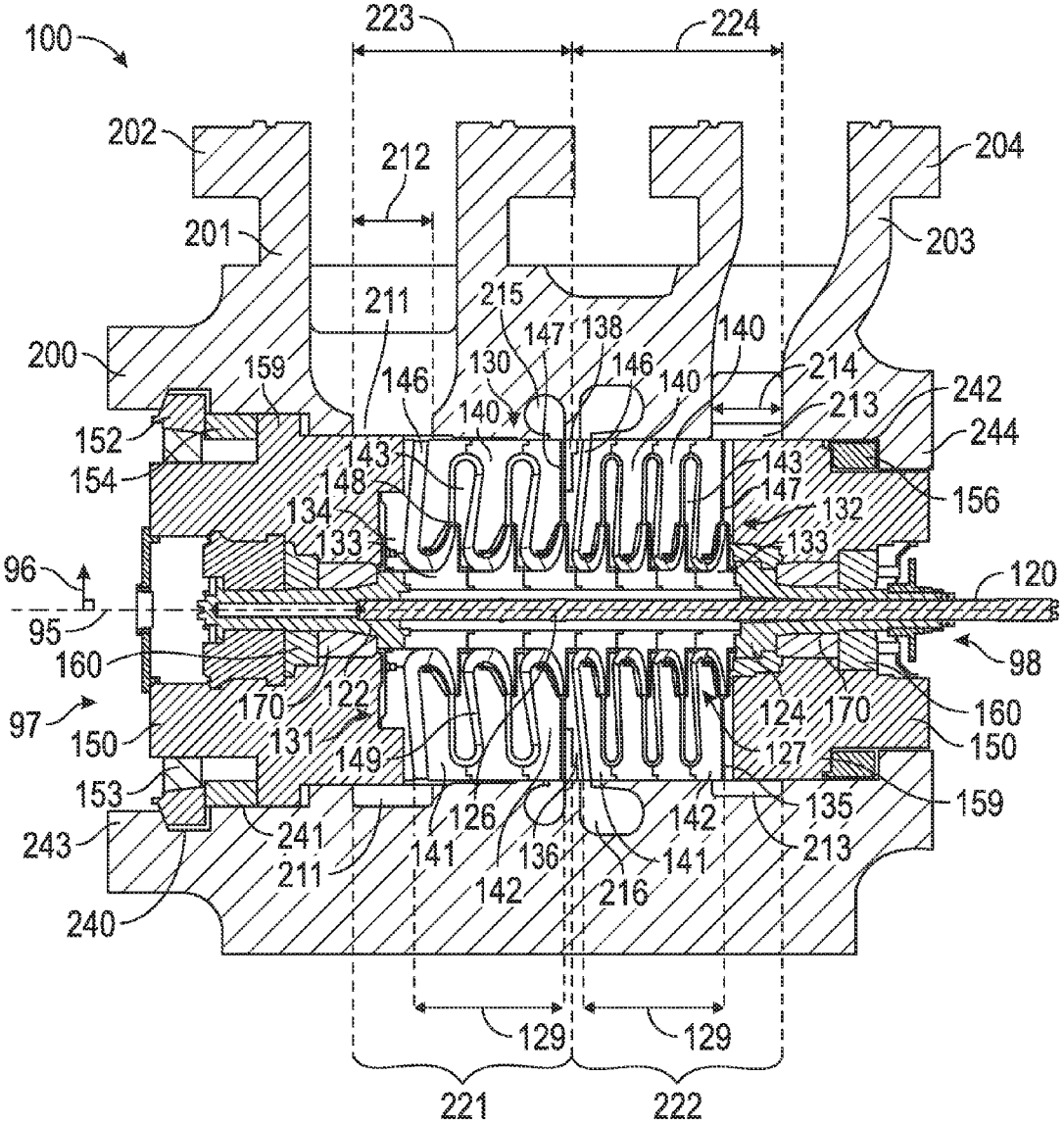
FIG. 1 is a cross-sectional view of a centrifugal gas compressor.

FIG. 1 is a cross-sectional view of a centrifugal gas compressor 100. Some of the surfaces have been left out or exaggerated (here and in other figures) for clarity and ease of explanation.

This disclosure may generally reference a center axis 95 of rotation of the centrifugal gas compressor, which may be generally defined by the longitudinal axis of its rotor 120. The center axis 95 may be common to or shared with various other concentric components of the centrifugal gas compressor 100. All references to radial, axial, and circumferential directions and measures refer to center axis 95, unless specified otherwise, and terms such as "inner" and "outer" generally indicate a lesser or greater radial distance from the center axis 95, wherein a radial 96 may be in any direction perpendicular and radiating outward from center axis 95.

In addition, this disclosure may reference a forward and an aft direction. Generally, all references to "forward" and "aft" are associated with the flow direction, relative to the center axis 95, of the compressed gas. In particular, the suction end 97 of the centrifugal gas compressor is referred to as the forward end or direction, and the discharge end 98 is referred to as the aft end or direction, unless specified otherwise.

The centrifugal gas compressor 100 includes a housing 200, a rotor 120, centrifugal impellers 133, staging 130, endcaps 150, a shear ring 152, a suction end stator spacer 154, a discharge end stator spacer 156, bearing assemblies 160, and seal assemblies 170.

Housing 200 may be a pressure containing housing and may include a body 210, a suction port 201, a discharge port 203, and one or more compartments within the body 210. Body 210 may generally be a solid of revolution forming a hollow interior, such as a hollow cylinder.

Suction port 201 may extend from body 210 proximal the suction end 97. Discharge port 203 may extend from body 210 proximal the discharge end 98. Discharge port 203 may be axially spaced apart from the suction port 201. Suction port 201 may include a suction port flange 202 and discharge port 203 may include a discharge port flange 204 for connecting to inlet and outlet process gas piping respectively.

The housing 200 may include one or more compartments. Each compartment may include a suction inlet and a discharge outlet. The suction inlet may axially align and be in flow communication with a suction port. The discharge outlet may axially align and be in flow communication with a discharge port. In some embodiments, the compartments are subdivided by a divider, such as compartment divider 138, rather than being divided by a physical separation integral to housing 200.

In the embodiment illustrated, housing 200 includes a first compartment 221 and a second compartment 222. First compartment 221 includes a first suction inlet 211 and a first discharge outlet 215. First suction inlet 211 may be formed in body 210 and may include a suction inlet width 212. The suction inlet width 212 may be a predetermined axial length of first suction inlet 211. First suction inlet 211 may be proximal suction end 97 and distal to discharge end 98. In the embodiment illustrated, first suction inlet 211 axially aligns and is in flow communication with suction port 201. First discharge outlet 215 may be formed in body 210 and is axially spaced apart from first suction inlet 211. First discharge outlet 215 is axially located between first suction inlet 211 and discharge end 98. First discharge outlet 215 is in flow communication with a central discharge port 207 (shown in FIG. 3). The discharge port 203 and the central discharge port 207 may be considered either a first or a second discharge port depending on the configuration of the housing 200.

Second compartment 222 includes a second suction inlet 216 and a second discharge outlet 213. Second suction inlet 216 may be formed in body 210 and may be adjacent first discharge outlet 215. Second suction inlet 216 may also be axially located between first discharge outlet 215 and discharge end 98. Second suction inlet 216 is in flow communication with a central suction port 205 (shown in FIG. 2). The suction port 201 and the central suction port 205 may be considered either a first or a second suction port depending on the configuration of the housing 200.

Second discharge outlet 213 may be formed in body 210 and may include a discharge outlet width 214. The discharge outlet width 214 may be a predetermined axial length of the second discharge outlet 213. Second discharge outlet 213 may be axially spaced apart from second suction inlet 216, may be proximal discharge end 98 and distal to suction end 97. Second discharge outlet 213 may axially align and be in flow communication with discharge port 203.

In embodiments with multiple compartments, first discharge outlet 215 and the second suction inlet 216 may be the outlet and inlet to a heat exchanger. Embodiments with a single compartment may include either the first compartment 221 with the first suction inlet 211 and the first discharge outlet 215, or the second compartment 222 with the second suction inlet 216 and the second discharge outlet 213.

The first compartment 221 may include a first compartment length 223, a predetermined axial length extending between and including first suction inlet 211 and first discharge outlet 215, and also including the axial space between the first suction inlet 211 and the first discharge outlet 215. The second compartment 222 may include a second compartment length 224, a predetermined axial length extending between and including second suction inlet 216 and second discharge outlet 213, and also including the axial space between the second suction inlet 216 and the second discharge outlet 213.

The rotor 120 may also include a suction end and a discharge end associated with the suction end 97 and the discharge end 98 of the centrifugal gas compressor 100 respectively. The rotor 120 may include a suction end stubshaft 122, a discharge end stubshaft 124, and a tie bolt 126. Tie bolt 126 may extend into and through suction end stubshaft 122 and discharge end stubshaft 124. Tie bolt 126 may be coupled to or otherwise joined to suction end stubshaft 122 and discharge end stubshaft 124. In the embodiment illustrated, tie bolt 126 extends into suction end stubshaft 122 and extends through discharge end stubshaft 124. Other rotor, stubshaft, and shaft configurations may also be used.

Centrifugal impellers 133 may be coupled or otherwise joined together forming a rotor assembly 127. The rotor assembly 127 may be coupled to rotor 120. In the embodiment illustrated, rotor assembly 127 extends between and couples to suction end stubshaft 122 and discharge end stubshaft 124. The length of rotor assembly 127 may depend on the required aero performance of the centrifugal impellers 133. The required aero performance may determine the number of centrifugal impellers 133 and the axial lengths of the centrifugal impellers 133. In some embodiments, the rotor 120 and the rotor assembly 127 do not include any rotor spacers. A rotor spacer may be used in embodiments where the staging is shorter than the housing 200 allows.

Staging 130 may be subdivided into compartment staging for each compartment within housing 200. In the embodiment illustrated, staging 130 includes first compartment staging 131 and second compartment staging 132. Each compartment staging is configured to include a staging inlet 146 and a staging outlet 147. The staging inlet 146 is in flow communication with an inlet in body 210, such as first suction inlet 211 or second suction inlet 216. The staging outlet 147 is in flow communication with an outlet in body 210, such as first discharge outlet 215 or second discharge outlet 213.

Each compartment staging may be configured to include an interstage passage 148 between adjacent centrifugal impeller 133 locations. Each interstage passage 148 may include a diffuser 149 configured to diffuse the compressed gas prior to being further compressed by a subsequent centrifugal impeller 133. Staging outlets 147 may also include a diffuser 149.

The number of stages and the length of each stage may be determined by the desired aero performance and the centrifugal impeller 133 associated with that stage. The staging length 129 for the staging in each compartment may be defined as the axial length from the staging inlet 146 to the staging outlet 147.

Staging 130 may include multiple diaphragms that are joined, such as by bolting, to form the various inlets, outlets, and passages of the staging 130. In the embodiment illustrated, first compartment staging 131 includes an inlet diaphragm 134 a first stage diaphragm 141, a stage diaphragm 140, a last stage diaphragm 142, multiple interstage diaphragms 143, and an outlet diaphragm 135. The inlet diaphragm 134 may form a portion of the staging inlet 146 and is adjacent the endcap 150 at the suction end 97. The first stage diaphragm 141 may form the remainder of the staging inlet 146 and may form a portion of an interstage passage 148.

The stage diaphragm 140 may form a portion of the diffuser 149 of a forward stage and a portion of the interstage passage 148 of an adjacent aft stage and may be joined to the first stage diaphragm 141. An inter compartment diaphragm 136 may be located between the first stage diaphragm 141 and the adjacent stage diaphragm 140 forming the remainder of the interstage passage 148, including a diffuser 149. The inter compartment diaphragm 136 may be joined to the stage diaphragm 140.

The last stage diaphragm 142 may form a portion of a diffuser 149 and may form a portion of the staging outlet 147. The last stage diaphragm 142 may be joined to the stage diaphragm 140. Another inter compartment diaphragm 136 may be joined to the last stage diaphragm 142 and may be located between the stage diaphragm 140 and the last stage diaphragm 142.

Staging 130 may include a compartment divider 138 and an interstage diaphragm 143. Compartment divider 138 may extend radially inward from housing 200 at the axial location between first discharge outlet 215 and second suction inlet 216. Compartment divider 138 may be joined to the last stage diaphragm 142 of the first compartment staging 131. Interstage diaphragm 143 may be joined to compartment divider 138 and may form a portion of the staging outlet 147 of the first compartment staging 131 and a portion of the staging inlet 146 of the second compartment staging 132.

Second compartment staging 132 may include similarly configured diaphragms as first compartment staging 131. In the embodiment illustrated, second compartment staging 132 includes another stage diaphragm 140 and another inter compartment diaphragm 136 between the first stage diaphragm 141 and the last stage diaphragm 142. Depending on the number of stages in each compartment staging, more or less diaphragms, such as stage diaphragms 140 and inter compartment diaphragms 136 may be used. In the embodiment illustrated, second compartment staging 132 also includes an outlet diaphragm 135 adjacent the last stage diaphragm 142 of the second compartment staging 132 and adjacent an endcap 150 located at the discharge end 98.

In the embodiment illustrated, first compartment staging 131 and second compartment staging 132 are configured to flow in the same direction. In other embodiments, first compartment staging 131 and/or second compartment staging 132 may be configured to flow in the opposite direction. The suction inlet and discharge outlet for each compartment may be reversed to accommodate the opposite flow. The corresponding suction port and discharge port for each compartment may also be reversed.

The endcaps 150 may be located at the suction end 97 and the discharge end 98. Each endcap 150 may be located at least partially within the body 210. Each endcap 150 may be a solid of revolution and may be configured to at least partially enclose an end of the centrifugal gas compressor 100. Each endcap 150 may include an endcap body 158 and a retaining feature 159 extending radially outward from the endcap body 158.

The rotor 120 and attached elements, such as the centrifugal impellers 133, are supported by the bearing assemblies 160. Bearing assemblies 160 may be located radially inward from an endcap 150 and may be supported by endcap 150. Seal assemblies 170 may be located axially adjacent each bearing assembly 160 and radially inward from an endcap 150. Seal assemblies 170 may be configured to maintain the pressure contained within the centrifugal gas compressor 100.

Housing 200 may also include a discharge endwall 244 and a suction endwall 243. The discharge endwall 244 may be an annularly shaped disk extending radially inward from body 210 at the discharge end 98. The discharge endwall 244 may form a discharge endcap slot 242 configured to retain an endcap 150 in the discharge end 98 of the housing 200.

The suction endwall 243 may extend radially inward from body 210 at the suction end 97. The suction endwall 243 may form a portion of a shear ring slot 240. A suction endcap slot 241 may be located adjacent the shear ring slot 240. The suction endcap slot 241 may have a smaller diameter than the shear ring slot 240. Suction endcap slot 241 may also have a larger diameter than the diameter of the compartments within the housing 200, such as the first compartment 221 or the second compartment 222.

In the embodiment illustrated, the discharge endwall 244, suction endwall 243, discharge endcap slot 242, suction endcap slot 241, and the shear ring slot 240 facilitate constructing the centrifugal gas compressor 100 from the discharge end 98 to the suction end 97. In other embodiments, the discharge endwall 244, suction endwall 243, discharge endcap slot 242, suction endcap slot 241, and the shear ring slot 240 may be reversed to facilitate constructing the centrifugal gas compressor from the suction end 97 to the discharge end 98.

Centrifugal gas compressor 100 may also include a shear ring 152, a ring support 153, and at least one stator spacer, such as a suction end stator spacer 154 and a discharge end stator spacer 156. A shear ring 152 is located in shear ring slot 240 and is configured to hold the various components of centrifugal gas compressor 100 together. Shear ring 152 may be located radially outward from a portion of endcap body 158 of the endcap 150 at suction end 97, and may at least partially radially align with retaining feature 159. A ring support 153 may be located radially between and contiguous to shear ring 152 and endcap body 158. Ring support 153 may be connected, such as by bolting, to endcap 150.

Suction end stator spacer 154 may be located axially between and contiguous to shear ring 152 and retaining feature 159 of the endcap 150 at the suction end 97. Suction end stator spacer 154 may be configured to axially locate and axially restrict the movement of the endcap 150 within housing 200. Suction end stator spacer 154 may include an annular shape.

Discharge end stator spacer 156 may be located axially and contiguous to discharge endwall 244 and the retaining feature 159 of the endcap 150 at the discharge end 98. Discharge end stator spacer 156 may be configured to axially locate and axially restrict the movement of the endcap 150 within housing 200. Discharge end stator spacer 156 may include an annular shape.

Figure 2:
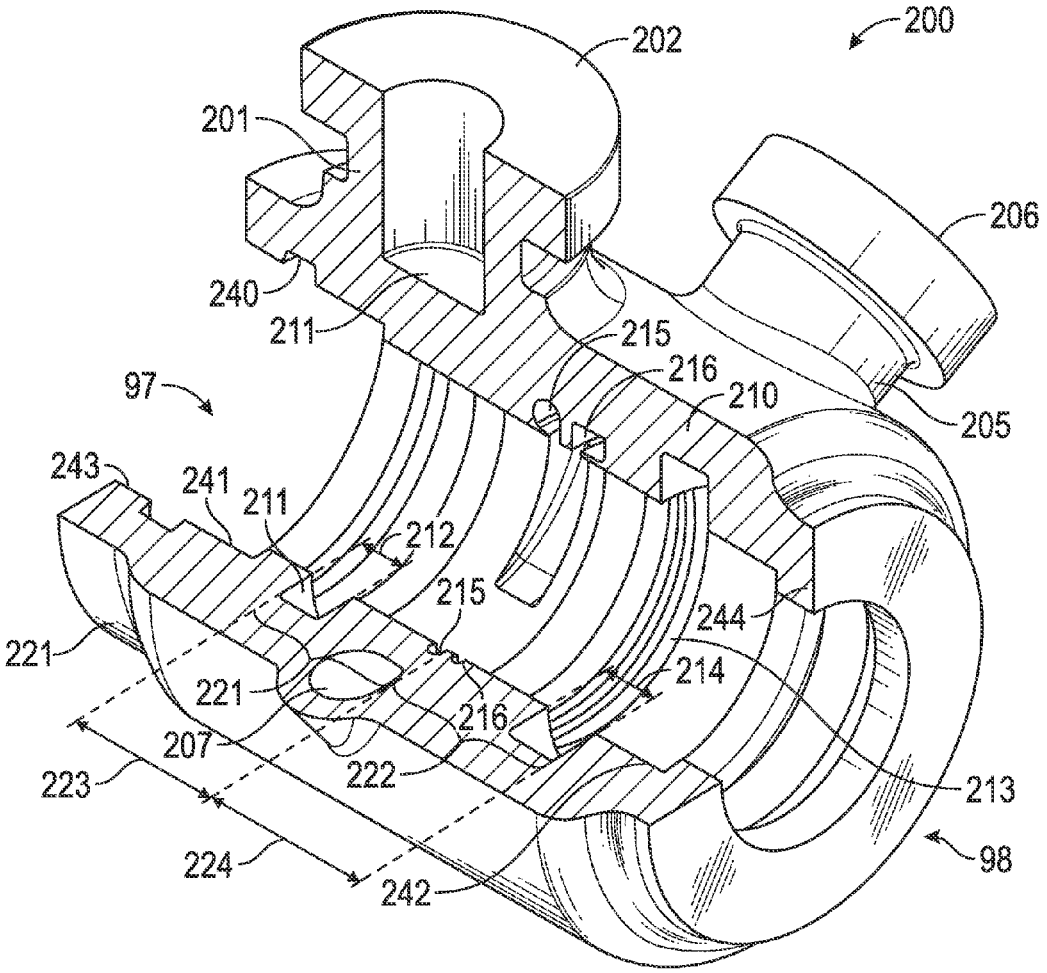
FIG. 2 is a cutaway view of the housing of FIG. 1.
Figure 3:
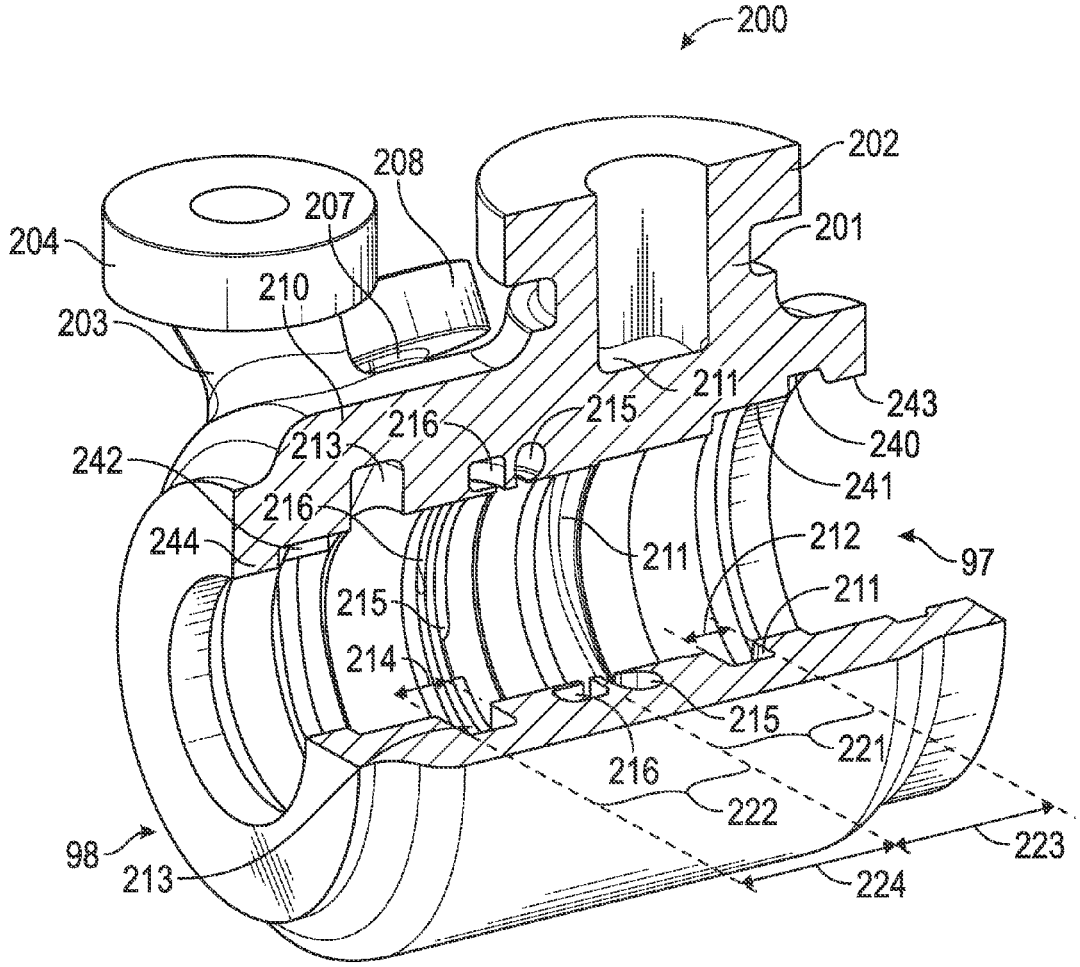
FIG. 3 is a cutaway view of the housing of FIG. 2 viewed from the opposite side.

FIG. 2 is a cutaway view of the housing 200 of FIG. 1. FIG. 3 is a cutaway view of the housing 200 of FIG. 2 viewed from the opposite side. FIG. 3 is oriented to include and show what was cut from FIG. 2. Referring to FIGS. 2 and 3, housing 200 may also include a central suction port 205 including a central suction port flange 206, and a central discharge port 207 including a central discharge port flange 208. Central discharge port 207 may be axially spaced apart from central suction port 205. Central suction port 205 may be axially aligned and in flow communication with second suction inlet 216. Central discharge port 207 may be axially aligned and in flow communication with first discharge outlet 215.

First suction inlet 211 may be a circumferential slot formed in body 210. The suction inlet width 212 may be a constant axial length. The depth of first suction inlet 211 may taper, decreasing as the slot extends circumferentially away from suction port 201. Second discharge outlet 213 may also be a circumferential slot formed in body 210. The discharge outlet width 214 may be a constant axial length. The depth of second discharge outlet 213 may taper, decreasing as the slot extends circumferentially away from discharge port 203. The decreasing cross-section of the first suction inlet 211 and the second discharge outlet 213 may maintain the velocity of the gas in the first suction inlet 211 and in the second discharge outlet 213. The first suction inlet 211 and the second discharge outlet 213 may include a rectangular cross-section.

The first discharge outlet 215 and the second suction inlet 216 may also be circumferential slots in body 210. The first discharge outlet 215 and the second suction inlet 216 may also taper to maintain the velocity of the gas in the first discharge outlet 215 and the second suction inlet 216.

Figure 4:
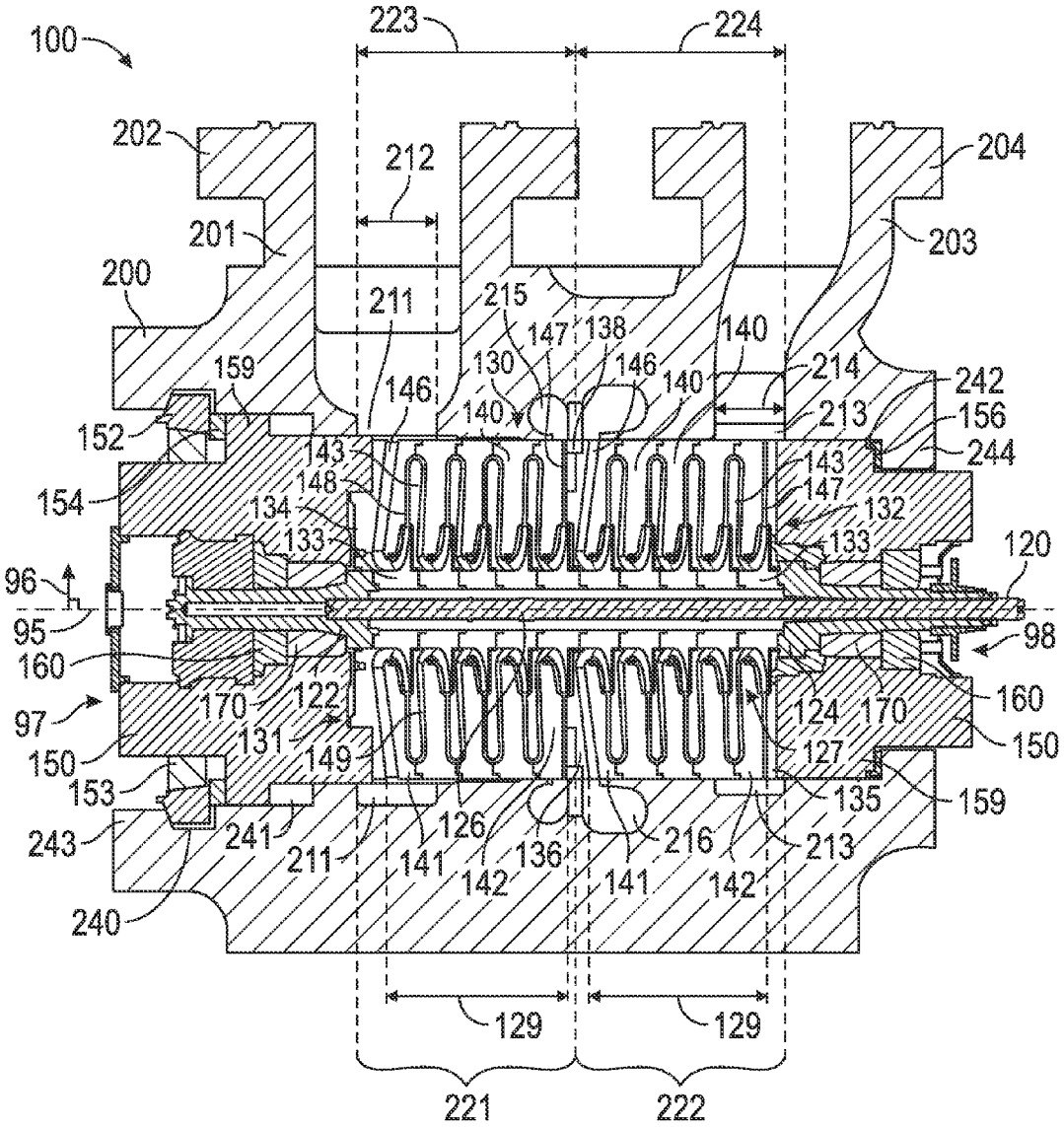
FIG. 4 is a cross-sectional view of an alternate embodiment of the centrifugal gas compressor of FIG. 1.

FIG. 4 is a cross-sectional view of an alternate embodiment of the centrifugal gas compressor 100 of FIG. 1. Referring to FIGS. 1 and 4, the staging lengths 129 for the first compartment staging 131 and the second compartment staging 132 are longer in the embodiment illustrated in FIG. 4 than the embodiment illustrated in FIG. 1. The first suction inlet 211 and the suction inlet width 212 are configured such that the staging inlet 146 for the first compartment staging 131 axially locates within the axial envelope of the first suction inlet 211 and is in flow communication with the first suction inlet 211 regardless of the staging length 129 of the first compartment staging 131. While the staging inlet 146 may be moved based on the staging length 129, the staging outlet 147 of the first compartment staging 131 may remain in a fixed/relatively fixed location. The first discharge outlet 215 is wide enough to be in flow communication with the staging outlet 147 in the fixed/relatively fixed location.

The second discharge outlet 213 and the discharge outlet width 214 are configured such that the staging outlet 147 for the second compartment staging 132 axially locates within the axial envelope of the second discharge outlet 213 and is in flow communication with the second discharge outlet 213 regardless of the staging length 129 of the second compartment staging 132. While the staging outlet 147 may be moved based on the staging length 129, the staging inlet 146 of the second compartment staging 132 may remain in a fixed/relatively fixed location. The second suction inlet 216 is wide enough to be in flow communication with the staging inlet 146 in the fixed/relatively fixed location.

In embodiments with a single compartment, either the configuration of the first compartment 221 with the first compartment staging 131, or the configuration of the second compartment 222 with the second compartment staging 132 may be used. Embodiments with a single compartment may also only include a single suction port, such as suction port 201 and a single discharge port, such as discharge port 203. The inlet and outlet of the selected configuration align with and are in flow communication with the single suction port and the single discharge port respectively.

In one embodiment, suction inlet width 212 is at least fifteen percent of the first compartment length 223. In another embodiment, suction inlet width 212 is from twenty percent to fifty percent of first compartment length 223. In yet another embodiment, suction inlet width 212 is from twenty-five percent to forty percent of first compartment length 223.

In some embodiments, suction inlet width 212 is configured to receive more than one staging length 129. In one embodiment, the staging length 129 is from a first length, the shortest staging length 129, to a second length, the longest staging length 129, where the second length is fifteen percent or more of the first length. In another embodiment, the variation in the staging length 129 from the first length to the second length is from fifteen percent to forty percent. In yet another embodiment, the variation in the staging length 129 is from twenty percent to thirty-five percent.

In some embodiments, suction inlet width 212 is at least 10.16 centimeters (4 inches). In other embodiments, suction inlet width 212 is from 10.16 centimeters (4 inches) to 25.4 centimeters (10 inches). In yet other embodiments, suction inlet width 212 is from 12.7 centimeters (5 inches) to 25.4 centimeters (10 inches).

In one embodiment, discharge outlet width 214 is at least fifteen percent of the second compartment length 224. In another embodiment, discharge outlet width 214 is from twenty percent to fifty percent of second compartment length 224. In yet another embodiment, discharge outlet width 214 is from twenty-five percent to forty percent of second compartment length 224.

In some embodiments, discharge outlet width 214 is configured to receive more than one staging length 129. In one embodiment, the staging length 129 is from a first length, the shortest staging length 129, to a second length, the longest staging length 129, where the second length is fifteen percent or more of the first length. In another embodiment, the variation in the staging length 129 from the first length to the second length is from fifteen percent to forty percent. In yet another embodiment, the variation in the staging length 129 is from twenty percent to thirty-five percent.

In some embodiments, discharge outlet width 214 is at least 10.16 centimeters (4 inches). In other embodiments, discharge outlet width 214 is from 10.16 centimeters (4 inches) to 25.4 centimeters (10 inches). In yet other embodiments, discharge outlet width 214 is from 12.7 centimeters (5 inches) to 25.4 centimeters (10 inches).

Each compartment includes either a suction inlet with the suction inlet width 212 or a discharge outlet with the discharge outlet width 214. In the embodiment illustrated the first compartment 221 includes the suction inlet width 212 and the second compartment includes the discharge outlet width 214. In other embodiments, the first compartment 221 includes the discharge outlet width 214 and/or the second compartment 222 includes the suction inlet width 213.

The location of endcap 150 may change from one embodiment to another depending on the length of the adjacent staging. The axial length of suction end stator spacer 154 and discharge end stator spacer 156 may be determined by the staging length 129 and the subsequent location of the endcap 150. As illustrated, the axial length of suction end stator spacer 154 illustrated FIG. 4 is shorter than the axial length of suction end stator spacer 154 illustrated in 152 due to the longer first compartment staging 131 in the embodiment illustrated in FIG. 4. Similarly, the axial length of discharge end stator spacer 156 illustrated in FIG. 4 is shorter than the axial length of discharge end stator spacer 156 illustrated in FIG. 1 due to the longer second compartment staging 132 in the embodiment illustrated in FIG. 4. In some embodiments, the housing 200 and endcap 150 is configured such that no stator spacer is required at a maximum staging length 129, the longest possible length of staging available within the compartment of the housing 200. In these embodiments, the endcap 150 may contact either the shear ring 152 or the discharge endwall 244 directly when the maximum staging length 129 is used.

The embodiments with a single compartment may include a fixed end relative to the inlet/outlet that is in a fixed/relatively fixed location. In such embodiments, the endcap 150 may be configured to remain in the same fixed location for all possible staging configurations. In these embodiments, the endcap 150 may not require a stator spacer and may contact either the shear ring 152 or the discharge endwall 244 directly.

The possible lengths of the suction end stator spacer 154 may correspond directly to the possible staging lengths 129 of the first compartment staging 131. In one embodiment, the suction end stator spacer 154 may be a nominal length when the staging length 129 is at its maximum, and may be increased by up to the possible change in staging length 129 where the staging length 129 is at its minimum. The possible change in staging length 129 may essentially be the suction inlet width 212, such as the suction inlet width 212 minus the width of staging inlet 146.

The possible lengths of the discharge end stator spacer 156 may similarly correspond directly to the possible staging lengths 129 of the second compartment staging 132. The possible change in staging length 129 may essentially be the discharge outlet width 214, such as the discharge outlet width 214 minus the width of the staging outlet 147.

INDUSTRIAL APPLICABILITY

Gas compressors such as centrifugal gas compressors are used to move process gas from one location to another.

Centrifugal gas compressors are often used in the oil and gas industries to move natural gas in a processing plant or in a pipeline. Centrifugal gas compressors are driven by gas turbine engines, electric motors, or any other power source.

The rotor 120 is generally connected to and rotated by the power source. During normal operation, process gas enters the centrifugal gas compressor 100 at the suction port 201. The process gas enters the staging at staging inlet 146 and is compressed by one or more centrifugal impellers 133 mounted to the rotor 120 and diffused by diffusers 149. The compressed process gas exits the staging 130 at staging outlet 147 and exits the centrifugal gas compressor 100 at a discharge port 203. In some embodiments, the centrifugal gas compressor includes multiple groups of staging. The process gas may exit centrifugal gas compressor and passed through a heat exchanger, before being directed into the second group of staging.

The size and length of the rotor assembly 127 and the corresponding staging may be determined by the aero performance and compression needs of the customer. Often, the housing is designed around the size and length of the staging after the staging has been determined. Designing the housing specific to the particular staging configuration may be costly and time consuming, increasing the delivery time and cost for a costumer. After the housing is designed, the housing must then be fabricated prior to building the centrifugal gas compressor.

Housing 200 is a universal housing that is configured to accommodate multiple staging lengths 129. Housing 200 is pre-designed and can be fabricated, such as by casting, prior to the staging design, may effectively remove the design and fabrication of housing 200 from the timeline between customer order and delivery of centrifugal gas compressor 100 to the customer. Housing 200 may reduce costs as an engineer does not need to generate a new design. The manufacturing costs of housing 200 may also be reduced as a single casting/single manufacturing method may be used for each housing 200 fabricated.

Housing 200 may also accommodate modification of an existing centrifugal gas compressor 100. Over time the aero performance and compression needs of a customer may change. As the housing 200 accommodates multiple lengths of staging, the staging may be modified rather than the customer requiring an entirely new centrifugal gas compressor 100. When modifying the staging, a new stator spacer, such as suction end stator spacer 154 or discharge end stator spacer 156 may be needed to accommodate the new staging length 129.

The preceding detailed description is merely exemplary in nature and is not intended to limit the invention or the application and uses of the invention. The described embodiments are not limited to use in conjunction with a particular type of centrifugal gas compressor. Hence, although the present disclosure, for convenience of explanation, depicts and describes a particular housing, it will be appreciated that the housing in accordance with this disclosure can be implemented in various other configurations, can be used with various other types of gas compressors, and can be used in other types of machines. Furthermore, there is no intention to be bound by any theory presented in the preceding background or detailed description. It is also understood that the illustrations may include exaggerated dimensions to better illustrate the referenced items shown, and are not consider limiting unless expressly stated as such.

What is claimed is:

1. A centrifugal gas compressor, comprising:

a housing including a body with a center axis;

a first compartment including:

a suction inlet formed in the body, a discharge outlet formed in the body axially spaced apart from the suction inlet and including a discharge outlet width, wherein the discharge outlet being a slot extending on the inner circumferential surface of the housing, and a first compartment length being, an axial length between and including the suction inlet and the discharge outlet;

compartment staging located within the first compartment, the first compartment staging including a staging inlet in flow communication with the suction inlet, a staging outlet in flow communication with the discharge outlet, and a staging length extending from the staging inlet to the staging outlet, where the discharge outlet width is at least fifteen percent of the compartment length;

a second compartment within the body located adjacent the first compartment, the second compartment including:

a second suction inlet formed in the body, wherein the second suction inlet is a circumferential slot extending on the inner circumferential surface of the housing, a second discharge outlet spaced apart from the second suction inlet;

a second compartment length being a second axial length between and including the second suction inlet and the second discharge outlet;

an endcap located adjacent the compartment staging and at least partially within the housing; and a stator spacer located adjacent the endcap and configured to locate the compartment staging within the housing.

2. The centrifugal gas compressor of claim 1, wherein the discharge outlet width is configured to receive more than one staging length, a variation in the staging length being from fifteen percent to forty percent.

3. The centrifugal gas compressor of claim 1, wherein the discharge outlet width is from 10.16 centimeters to 25.4 centimeters.

4. The centrifugal gas compressor of claim 1, wherein the body includes a suction end and a discharge end, and wherein the second discharge outlet is located between the discharge end and the second suction inlet, the suction inlet is located adjacent the second discharge outlet and between the second discharge outlet and the discharge end, and the discharge outlet is located between the suction outlet and the discharge end.

* * * * *